US008959782B1

(12) United States Patent
Schaefer

(10) Patent No.: US 8,959,782 B1
(45) Date of Patent: Feb. 24, 2015

(54) ARCHERY SIGHT WITH CORRELATED DISTANCE INDICATORS

(71) Applicant: Benjamin P. Schaefer, Sauk Centre, MN (US)

(72) Inventor: Benjamin P. Schaefer, Sauk Centre, MN (US)

( * ) Notice: Subject to any disclaimer, the term of this patent is extended or adjusted under 35 U.S.C. 154(b) by 166 days.

(21) Appl. No.: 13/873,197

(22) Filed: Apr. 29, 2013

(51) Int. Cl.
*F41G 1/467* (2006.01)

(52) U.S. Cl.
CPC ..... *F41G 1/467* (2013.01)
USPC ..... 33/265; 124/87

(58) Field of Classification Search
USPC ..... 33/265; 124/87
See application file for complete search history.

(56) References Cited

U.S. PATENT DOCUMENTS

| | | | | | |
|---|---|---|---|---|---|
| 2,332,080 | A | | 10/1943 | Howe | |
| 2,461,122 | A | | 2/1949 | McQuitty | |
| 2,574,599 | A | * | 11/1951 | Stieber | 124/23.1 |
| 2,767,472 | A | * | 10/1956 | Kocur | 33/265 |
| 3,308,540 | A | * | 3/1967 | Dean | 33/262 |
| 4,170,071 | A | | 10/1979 | Mann et al. | |
| 4,481,717 | A | | 11/1984 | Kowalski | |
| 5,914,775 | A | * | 6/1999 | Hargrove | 356/3.13 |
| 6,073,352 | A | | 6/2000 | Zykan et al. | |
| 6,134,793 | A | * | 10/2000 | Sauers | 33/265 |
| 6,618,949 | B1 | * | 9/2003 | Keener | 33/265 |
| 6,634,111 | B2 | | 10/2003 | LoRocco | |
| 7,475,485 | B1 | | 1/2009 | Hamm et al. | |
| 2011/0252654 | A1 | * | 10/2011 | Edmundson | 33/228 |

OTHER PUBLICATIONS

"Judging Distance: An Overlooked Skill for Bow Hunters", Feb. 1, 2013, HTTP://www.rockymountainhunting.com/articles/articles-judging-distance.html, 3 pages, Rocky Mountain Ranchers, LTD.

* cited by examiner

*Primary Examiner* — Christopher Fulton
(74) *Attorney, Agent, or Firm* — Albert W. Watkins

(57) ABSTRACT

A hunting sight has a plurality of pins that each have a head having a unique characteristic such as a color or shape. Each pin head is sighted for a particular discrete distance from the sight to a target. A plurality of markers are anchored in arcs at discrete predetermined radial distances from a hunting location such as a hunting stand or hunting blind. Each of the markers have a characteristic such as a color or shape that matches the unique characteristic of the pin head that corresponds to the distance between the sight and marker. A method of correlating the archery sight with distance indicators, and of using the archery sight with correlated distance indicators, is also disclosed.

10 Claims, 3 Drawing Sheets

ARCHERY SIGHT WITH CORRELATED DISTANCE INDICATORS

BACKGROUND OF THE INVENTION

1. Field of the Invention

This invention pertains generally to archery, and more particularly to an archery sight having correlated distance indicators.

2. Description of the Related Art

The modern sport of archery has evolved greatly from the earliest days of recorded history. Ancient archers used the bow and arrow as a tool for survival, for gathering food and for protection. Through the centuries, there have been many technological and social advances. While the bow and arrow are still useful for basic survival functions, most modern archers are hunting, practicing with targets, or otherwise enjoying the sport.

The equipment used by modern archers is also much different than that of the earliest hunters. Today, bows range from simple bent or stretched sticks made in the traditions of the earliest hunters to the recurve and cross bows that were developed as humans gained skill in woodworking, to the ultra-modern compound bows of the last few decades. As might be appreciated, each of these bows have very different characteristics, resulting in arrows that travel at greatly differing speeds.

Like the bows, the arrows of today also cover a wide gamut of materials and geometries. There are wooden, aluminum, fiberglass and graphite arrows, and even more esoteric composites and alloys available. Fletchings will almost always be provided at the tail of the arrow. These fletchings are designed to stabilize the flight of the arrow, and may be used to cause the arrow to spin or rotate about a longitudinal axis, which can further improve the overall straightness of flight. In addition, the fletchings may sometimes be used to provide color for locating an errant arrow, and also used to provide unique appearance that might be specific to a single archer. The fletchings were commonly fabricated from bird feathers, which have low weight and good aerodynamic performance, though there are now many similar synthetic materials available. In practice, a single fletching is aligned in a straight or slight spiral or helical pattern about the arrow shaft, and then glued along the edge of contact between the fletching and the shaft. As may be appreciated, these fletchings are often fragile, and in many cases easily damaged or even stripped from the shaft if handled roughly.

One of the challenges that arise from the diverse equipment used in modern archery is how to enable an archer to account for the many variables, and still reliably and accurately shoot the arrow. As may be appreciated in this very old art, a number of artisans have heretofore attempted to address this need. One exemplary US patent, the teachings and contents which are incorporated herein by reference, is U.S. Pat. No. 2,332,080 by Howe, entitled "Bow sight". As illustrated herein as prior art FIG. 1, Howe illustrate a recurve bow 1 having an early sight that comprised pins 2, having heads 3 that were each colored uniquely, so that each pin 2 denoted a different distance to the target. This allows the archer to preset the location of pins 2 within an array of pin holes to match desired distances for a particular bow and arrow combination, such as at a target range. Then when hunting, the archer can quickly sight a target without any manual adjustments to the sight. This bow sight certainly improved the ease of sighting, but also requires the archer to remember the particular distances that each pin 2 designates. Then the archer must accurately judge the distance from the archer to target, select the proper pin head 3 to align to, and then fire the arrow. For a highly skilled archer, this may be second nature, but in the heat of the moment, even the most skilled and practiced archers can momentarily become confused about the particular pin to be used at a particular distance.

To reduce the opportunity for confusion, and to assist the archer with distance determination, Logsdon in U.S. Pat. No. 8,272,137 entitled "Selective fiber optic sight system", the teachings and contents which are incorporated herein by reference and illustrated herein as prior art FIG. 2, proposes a bow 1 having an archery sight 4 that includes fiber optic pins 5 having illuminating tips 6. A laser range finder provides a distance measurement, and the appropriate pin 5 and illuminating tip 6 is activated for the desired target. This sight 4 overcomes several of the limitations of the prior art, by eliminating the need for the archer to judge distance, and by also selecting the appropriate sighting pin 5 for the archer to align with. Nevertheless, and in spite of the advantages of the Logsdon sight, there remain several drawbacks. Among these is the cost, requiring the archer to buy a computer-controlled sight and compatible laser rangefinder. Furthermore, a laser-controlled range finder and computer controlled sight each require batteries, which are well known to lose charge at the most inopportune moments. The incorporation of electronics also makes the apparatus far more susceptible to the environment and far more likely to fail. In addition, when a target is intermediate between two discrete distances set by the sighting pins 5, the user must again approximate to a point between the illuminated pin and the adjacent pin. However, this again requires the archer, in the heat of the moment, to remember which pin 5 above or below the illuminated tip 6, is the correct pin to select. Again, in many instances this will become second nature to many archers. Unfortunately, with the excitement of the animal approaching, there still remain a significant number of archers who may temporarily be overwhelmed, and not select the proper adjacent pin. This is particularly true for younger and less frequent archers, both for whom the cost of the Logsdon sight is also more difficult to justify.

A number of other patents that are exemplary of the art, the teachings which are incorporated herein by reference, include: U.S. Pat. No. 2,461,122 by McQuitty, entitled "Aim indicator"; U.S. Pat. No. 4,170,071 by Mann et al, entitled "Sighting apparatus"; U.S. Pat. No. 4,481,717 by Kowalski, entitled "Archery bow sight"; U.S. Pat. No. 6,073,352 by Zykan et al, entitled "Laser bow sight apparatus"; U.S. Pat. No. 6,634,111 by LoRocco, entitled "Multiple pin sight for an archery bow"; and U.S. Pat. No. 7,475,485 by Hamm et al, entitled "Archery bow yardage tape apparatus". In addition to the aforementioned patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, an archery sight and correlated distance indicators. The archery sight comprises a plurality of discrete sighting points, each one of the discrete sighting points having a unique characteristic differing from every other one of the discrete sighting points. Each of the plurality of discrete sighting points is uniquely associated with sighting a particular distance to a target. The distance indicators comprise a plurality of discrete markers. Individual ones of the plurality of discrete markers has a characteristic matched with a single one of the unique characteristics of the discrete sighting points and is located substantially at the particular distance from the sighting points associated with the unique characteristic.

In a second manifestation, the invention is a method of correlating an archery sight having at least two sighting points, each having a unique characteristic, with at least two archery distance markers. A first one of the at least two archery distance markers has a first sighting point unique characteristic and a second one of the at least two archery distance markers has a second sighting point unique characteristic. According to the method, the steps comprise determining a hunting location; anchoring the first one of the at least two archery distance markers substantially at a first distance from the hunting location; locating the second one of the at least two archery distance markers substantially at a second distance from the hunting location; setting a first one of the at least two sighting points to correspond to shooting an arrow substantially the first distance; and arranging a second one of the at least two sighting points to correspond to shooting an arrow substantially the second distance.

OBJECTS OF THE INVENTION

Exemplary embodiments of the present invention solve inadequacies of the prior art by providing a plurality of markers, each set at a predetermined distance from a hunting stand or blind, and each colored to a color chosen to indicate a unique distance. A hunting sight has a plurality of pins that each have uniquely colored heads, with each colored head sighted for the proper distance to the matching colored marker.

A first object of the invention is to enable an archer to preset a sight for a particular bow and arrow combination, prior to hunting. A second object of the invention is to enable the archer to preset a plurality of markers at predetermined distances, also prior to hunting. Another object of the present invention is to correlate the pins and markers so that they each uniquely correspond to the other at particular distances. A further object of the invention is to enable an archer to easily and quickly identify the correlated sight pins and markers. Yet another object of the invention is to facilitate range finding without requiring additional apparatus, or motion or movement required to operate and use such additional apparatus. An additional object of the invention is to allow the archer to readily adapt to points intermediate between preset distances. Yet another object of the present invention is to enable the archer to achieve the aforementioned objectives with minimal additional cost or expertise required, to enable younger and more infrequent archers to obtain the benefits of the present invention.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 2:
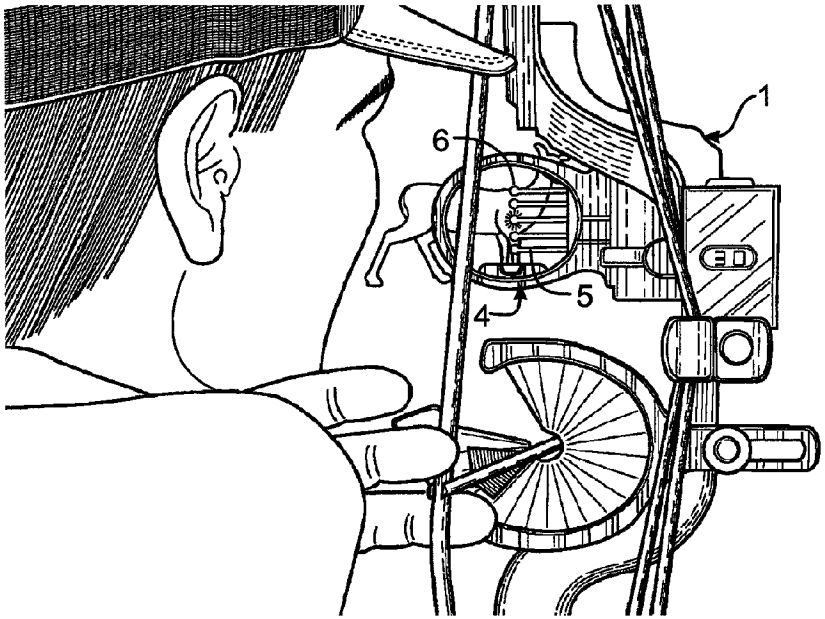
FIG. 2 (PRIOR ART)
FIG. 2 illustrates a second prior art sight having pin heads that may be selectively illuminated in association with a laser range finder.
Figure 1:
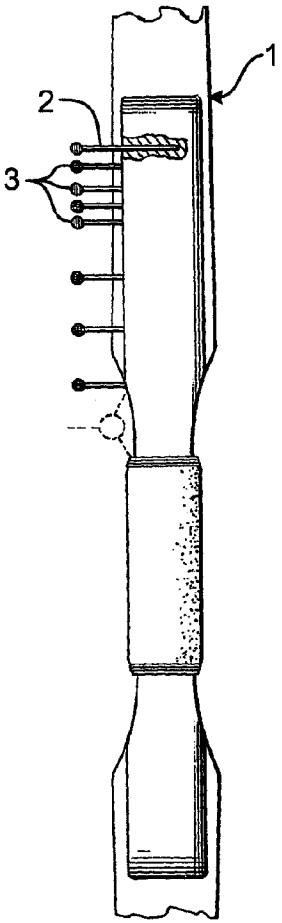
FIG. 1 (PRIOR ART)
FIG. 1 illustrates a prior art sight having uniquely colored pin heads.
Figure 3:
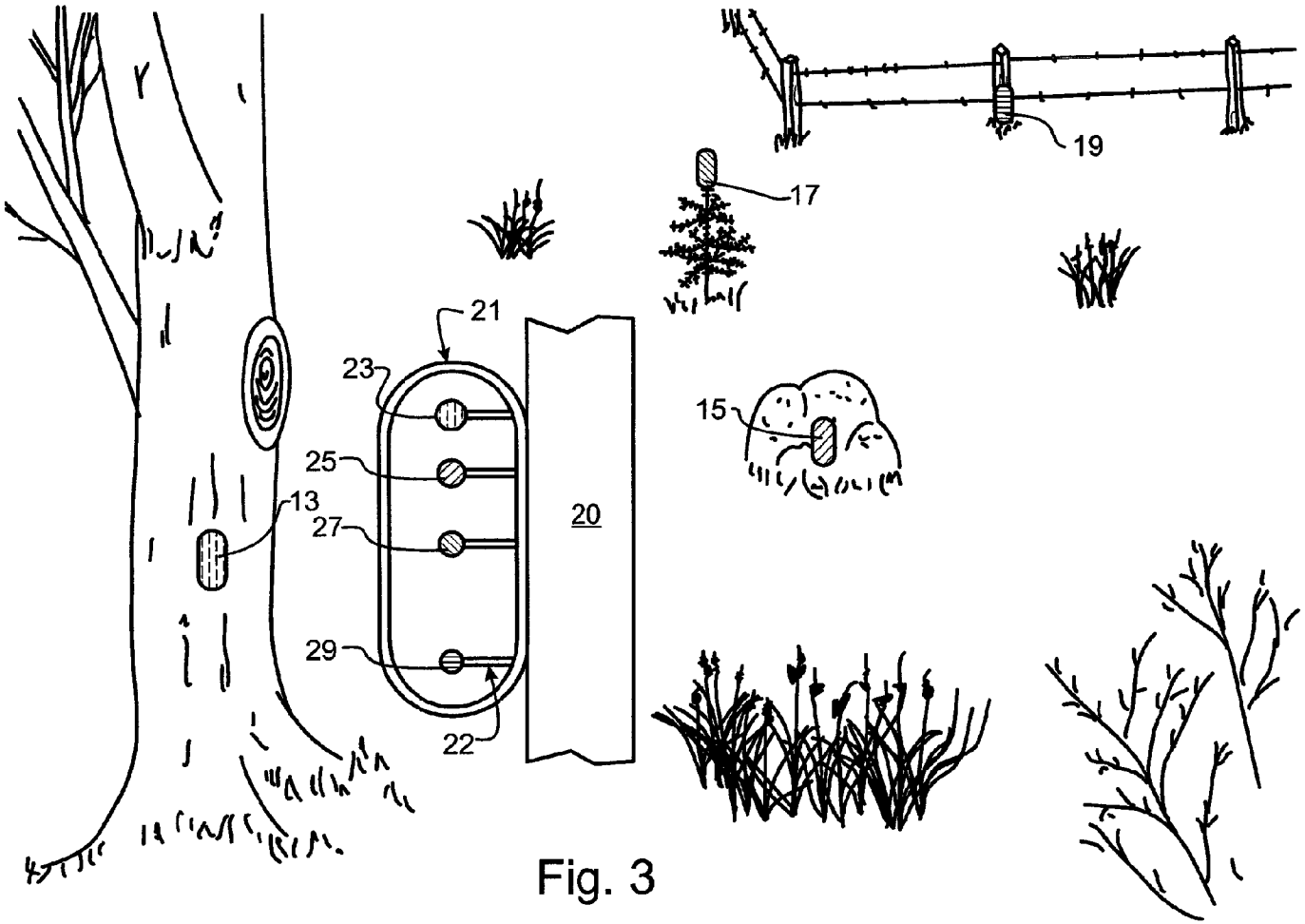
FIG. 3 illustrates a preferred embodiment archery sight with correlated distance indicators designed in accord with the teachings of the present invention.

Manifested in the preferred embodiment, the present invention provides markers using consistent indicia uniquely associated with particular discrete distances; and correlation between sight distance indicia and marker distance indicia. As illustrated in FIG. 3, preferred embodiment archery sight 21 may be mounted on a suitable bow 20 in the standard way. As illustrated, sight 21 includes four pins 22, though this is simply for illustrative purposes, and in fact sight 21 may include any number of pins as may be desired or appropriate for a particular archer, bow and arrow combination.

Each pin 22 will preferably have a head having a unique indicia or characteristic. In the preferred embodiment, the indicia or characteristic is color. As illustrated, pin head 23 is violet, pin head 25 is brown, pin head 27 is green, and pin head 29 is blue. Correlated with pin heads 23-29 are distance markers 13-19. Marker 13 for exemplary purposes might indicate a 10 yard distance, and is colored violet to correlate with pin head 23. Marker 15 might, for exemplary purposes, indicate 20 yards, and is colored brown to correlate with pin head 25. Marker 17 might indicate 30 yards, and is colored green to correlate with pin head 27. Marker 19 might indicate 40 yards, and is colored blue to correlate with pin head 29.

While color is used to illustrate the preferred embodiment, the indicia or characteristic could be any unique indicator. For exemplary purposes only, and not limiting the inventions solely thereto, markers 13-19 may have a unique geometry, and pin heads 23-29 may have a matching unique geometry. As but one example, marker 13 and pin head 23 might each be in the shape of a circle, ball or sphere, marker 15 and pin head 25 might each be in the shape of a square or block, marker 17 and pin head 27 might each be in the shape of a diamond, and marker 19 and pin head 29 might each be in the shape of a star.

While FIG. 3 illustrates only one marker 13, one marker 15, one marker 17 and one marker 19, the invention is not so limited. More desirably, an archer will first determine a hunting location, such as a deer stand or hunting blind, or other suitable location. Then the archer will set up a plurality of markers 13 in a radius or even a full circumference about a deer stand, hunting blind or the like, and likewise set up a plurality of markers 15, markers 17 and markers 19. The markers, as described herein above, may be mounted on any convenient structures, such as trees, bushes, fence posts, rocks, or any anchor may be provided for the mounting of distance markers.

Figure 4:
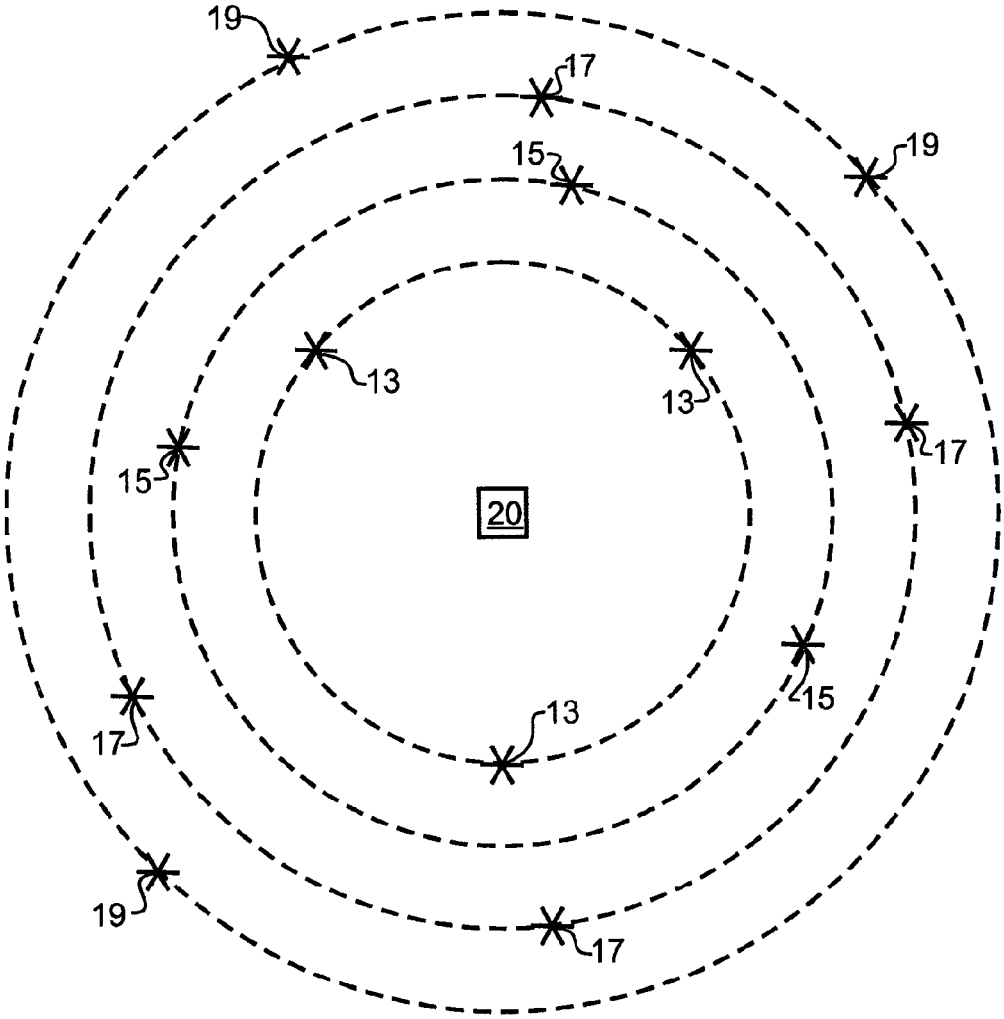
FIG. 4 illustrates schematically the arrangement of various correlated distance indicators about a bow and sight from a simplified map view.

The arrangement of markers, for exemplary purposes only and not solely limiting thereto, is illustrated from a map view in FIG. 4, where three markers 13 are set about a first and smallest radius from bow 20, three markers 15 are set about a second and slightly larger radius from bow 20, four markers 17 are set about a third and yet larger radius, and so forth. Regardless of the direction the archer wishes to shoot, he may quickly observe where the target is with respect to the correlated distance markers 13-19. If the target, a deer for example, were to be midway between distance markers 13 and distance markers 15, then the archer can quickly match the color, geometry or other predetermined indicia and thereby select to align midway between pin head 23 and pin head 25.

In the preferred embodiment, each of markers 13-19 are fabricated from sheet stock such as polyethylene, and each are provided with at least one through hole, facilitating mounting by allowing an installer to pass a fastener such as a screw or nail through the hole and into a suitable anchor. The anchor may be a tree, such as illustrated with markers 13 and 17, a fence post such as with marker 19, a rock such as illustrated with marker 15, and any other suitable anchor as might be available. If there are not any available pre-existing anchors, then markers 13-19 may be affixed with posts or even directly to the ground, so long as they will be visible during hunting. Where snow or leaves might accumulate, ground attachment is clearly less desirable, and so anchoring to stakes or other static structures or articles is much preferred. Further, since the distance indicators will not be targets, the anchor can also optionally be a building or other fixture.

From the foregoing figures and description, several additional features and options become more apparent. First of all, distance markers 13-19 may be manufactured from a variety of materials, including metals, resins and plastics, ceramics or cementitious materials, or even combinations, composites or laminates of the above. The specific material used may vary, though special benefits are attainable if several important factors are taken into consideration. First, distance markers 13-19 will preferably be left outdoors in a semi-permanent manner once installed. By using materials that are both resistant to moisture and exposure to the sun and temperature extremes, the distance markers will last for many years. Furthermore, it is preferable that all materials are sufficiently tough and durable to not fracture, even when great forces are applied thereto. This permits the markers to be installed without concern for breakage, so nailing or over-tightening of a screw will not destroy the markers. A preferred material as outlined herein above is polyethylene, which has the advantages of being relatively low cost, easily colored, and stain, chemical and corrosion resistant, and if so used, would further incorporate Ultra-Violet (UV) inhibitors. Other contemplated materials, for exemplary purposes and not solely limited thereto, include: high density polyethylene; Ultra-High Molecular Weight (UHMW) polyethylene which has the advantage of being extremely tough and durable to withstand great force and scuff resistant; polypropylene which has characteristics intermediate to high density polyethylene and UHMW; Poly-Vinyl Chloride (PVC); polyurethane; acrylic; and the like. While metals such as aluminum and appropriately coated or galvanized steel are also contemplated herein, and may have many of the desired characteristics, the necessary coatings that lend color to metals tend to be scratched or separated easily, and to provide durability these coatings are commonly fabricated from the very plastics described above. However, where geometry serves as the unique characteristic, aluminum or suitably galvanized steel may also find ready application.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, an archery sight and distance indicators, the archery sight comprising:

a plurality of discrete sighting points, each one of said discrete sighting points having a unique sighting point characteristic differing from every other one of said discrete sighting points, each of said plurality of discrete sighting points uniquely associated with sighting a particular distance to a target;

the distance indicators comprising:

a plurality of discrete markers, individual ones of said plurality of discrete markers having a marker characteristic matched with a single one of said unique sighting point characteristics and located substantially at said particular distance from said sighting points associated with said unique sighting point characteristic.

2. The combination archery sight and distance indicators of claim 1, wherein said plurality of discrete markers further comprises:

a first set of discrete markers each substantially located a first distance from said sighting points and each having a first marker characteristic matched with a single one of said unique sighting point characteristics; and a second set of discrete markers each substantially located a second distance from said sighting points different from said first distance and each having a second marker characteristic matched with a single one of said unique sighting point characteristics.

3. The combination archery sight and distance indicators of claim 1, wherein said unique sighting point characteristic further comprises a unique color.

4. The combination archery sight and distance indicators of claim 1, wherein said unique sighting point characteristic further comprises a unique geometric shape.

5. The combination archery sight and distance indicators of claim 4, wherein said plurality of discrete markers further comprises:

a first set of discrete markers each substantially located a first distance from said sighting points and each having a first marker characteristic geometric shape matched with a single one of said unique sighting point characteristic geometric shapes; and a second set of discrete markers each substantially located a second distance from said sighting points different from said first distance and each having a second marker characteristic geometric shape matched with a single one of said unique sighting point characteristic geometric shapes and different from said first marker characteristic geometric shape.

6. A method of correlating an archery sight having at least two sighting points each having a unique characteristic with at least two archery distance markers, a first one of said at least two archery distance markers having a first sighting point unique characteristic and a second one of said at least two archery distance markers having a second sighting point unique characteristic, comprising the steps of:

determining a hunting location;

anchoring said first one of said at least two archery distance markers substantially at a first distance from said hunting location;

locating said second one of said at least two archery distance markers substantially at a second distance from said hunting location;

setting a first one of said at least two sighting points to correspond to shooting an arrow substantially said first distance; and arranging a second one of said at least two sighting points to correspond to shooting an arrow substantially said second distance.

7. The method of correlating an archery sight having at least two sighting points with at least two archery distance markers of claim 6, further comprising the step of anchoring a plurality of said at least two archery distance markers, each having said first sighting point unique characteristic, about a first circumference substantially located at a first distance from said hunting location.

8. The method of correlating an archery sight having at least two sighting points with at least two archery distance markers of claim 7, further comprising the step of placing a second plurality of said at least two archery distance markers, each having said second sighting point unique characteristic, about a second circumference substantially located at a second distance from said hunting location.

9. The method of correlating an archery sight having at least two sighting points with at least two archery distance markers of claim 8, further comprising the steps of:

selecting a first unique color for said first sighting point unique characteristic, and choosing a second unique color different from said first unique color for said second sighting point unique characteristic.

10. The method of correlating an archery sight having at least two sighting points with at least two archery distance markers of claim 8, further comprising the steps of:

selecting a first unique shape for said first sighting point unique characteristic, and choosing a second unique shape different from said first unique shape for said second sighting point unique characteristic.

* * * * *